United States Patent [19]

Hollrock

[11] 4,181,996

[45] Jan. 8, 1980

[54] MACHINE FOR WASHING GOLF BALLS AND THE LIKE

[76] Inventor: J. Richard Hollrock, 51 Longview Dr., Simsbury, Conn. 06070

[21] Appl. No.: 888,490

[22] Filed: Mar. 20, 1978

[51] Int. Cl.[2] ..... A63B 47/04

[52] U.S. Cl. ..... 15/21 A

[58] Field of Search ..... 15/21 A, 3.13, 3.14, 15/3.15, 3.16, 3.2

[56] References Cited

U.S. PATENT DOCUMENTS

| | | | |
|---|---|---|---|
| 665,201 | 1/1901 | Fay et al. | 15/21 A |
| 1,952,619 | 3/1934 | Benner et al. | 15/3.2 X |
| 2,691,786 | 10/1954 | Reading | 15/3.2 X |
| 3,038,186 | 6/1962 | Davy | 15/21 A |

*Primary Examiner*—Edward L. Roberts
*Attorney, Agent, or Firm*—McCormick, Paulding & Huber

[57] ABSTRACT

A golf ball washing machine for handling a high volume of golf balls is comprised of a wash tub and a scrubbing unit mounted in the tub. A plurality of golf balls are deposited in bulk in a stowage space formed between the tub walls and the scrubbing unit. Baffle panels guide the balls downwardly in the stowage space to the lower end of the scrubbing unit and a fluid injection system feeds the golf balls one by one into a scrubbing chamber. The chamber is formed by a generally cylindrical shell mounted vertically within the tub and a brush rotates coaxially within the shell and scrubs golf balls sandwiched between the brush and shell walls. A track extending from the lower end of the shell to a discharging spout above aids the brush in moving the golf balls upwardly through the scrubbing chamber in opposition to gravitational forces. The rotating brush also circulates a cleaning solution through the lower end of the shell to energize the fluid injection system which draws golf balls into the scrubbing chamber.

20 Claims, 6 Drawing Figures

MACHINE FOR WASHING GOLF BALLS AND THE LIKE

BACKGROUND OF THE INVENTION

The present invention relates to a machine for washing balls and the like in high volume. More particularly, the invention is concerned with a golf ball washing machine which accepts a plurality of golf balls in bulk and scrubs the balls individually.

Prior art machines for washing a plurality of small round objects such as golf balls, eggs, fruit and the like are shown in U.S. Pat. Nos. 665,201, 2,691,786 and 3,038,186. The washing machines illustrated in these patents share a common feature in that they utilize a brush or other scrubbing component which rotates about a vertical axis and sandwiches balls and the like between the brush periphery and a surrounding cylindrical shell. An inner helical track extends between opposite ends of the shell, and as the brush is rotated and scrubs the balls, the track aids in moving the balls through the shell to a discharge point. The prior art machines in U.S. Pat. Nos. 2,691,786 and 3,038,186 move the balls upwardly through the shell and thus utilize the full effect of gravitational forces to maximize the scrubbing action of the brush which advances the balls through the machine.

In each of the prior art patents a special feed mechanism is utilized to introduce the objects to be cleaned into the scrubbing unit. The feed mechanisms commonly have hoppers which are attached to one side or the top of the machine and a gravity feed duct which leads from the hopper into the scrubbing unit. The feed hoppers and ducts are employed to separate or break up a plurality of balls into smaller groups that can be satisfactorily ingested by the scrubbing unit. Ideally, one would prefer to avoid or minimize the additional structure associated with the feed mechanisms and thereby achieve a more compact machine. However, it is generally not practical to feed a plurality of loose objects in bulk into a machine without a feed mechanism which breaks down the plurality into smaller, more manageable groups.

It is, accordingly, a general object of the present invention to provide a washing machine for balls and the like which is compact in structure and efficient in operation.

It is a further object of the invention to provide a washing machine which can handle a large quantity of ball-like objects in bulk and process such objects individually at high speed through a scrubbing unit.

SUMMARY OF THE INVENTION

The present invention resides in a machine for washing a plurality of uniform balls or the like such as golf balls, fruits or poultry eggs.

The machine includes a wash tub having an open top and a closed bottom for holding a quantity of cleaning solution. An overflow hole may be provided in the wall of the tub at a predetermined distance from the bottom to establish a given level of cleaning solution in the tub at the beginning of a washing process.

A scrubbing chamber is mounted within the tub and includes a generally cylindrical shell standing in upright or vertical fashion in spaced relationship from the sides of the tub. A stowage space is defined between the sides of the tub and shell for receiving and holding a plurality of loose balls to be scrubbed. Also within the scrubbing chamber is a rotatable brush mounted coaxially within the shell and in spaced relationship from the cylindrical shell wall. The spacing between the shell and brush is selected to allow a ball to be sandwiched by the brush against the shell wall as the ball is scrubbed.

The lower end of the shell has an inlet opening for admitting balls and the cleaning solution. Track means are mounted within the space between the brush and shell and lead toward the upper end for carrying the balls upwardly in opposition to gravity as the brush is rotated by a motor and scrubs the balls. In one form the track means comprises a plurality of angled brackets arranged in a step-like manner and projecting inwardly toward the brush from the inner wall of the shell.

Feed means lead from the stowage space between the tub and shell and feed the balls deposited loosely in the stowage space in an orderly manner to the inlet opening at the lower end of the shell. In one embodiment of the invention the feed means is comprised by a set of panels serving as guide baffles which divide the plurality of balls in the stowage space into a more linear series adjacent the lower end of the shell, and fluid injection means which draws the golf balls from the linear series and injects them one by one into the scrubbing chamber. The injection means includes a conduit connected to the inlet opening of the shell tangentially of the brush. A discharge opening also in the shell at the lower end allows a cleaning solution to be circulated through the conduit and shell between the inlet and discharge opening, and the circulated solution serves to draw the golf balls into the chamber.

DESCRIPTION OF PREFERRED EMBODIMENTS

Figure 1:
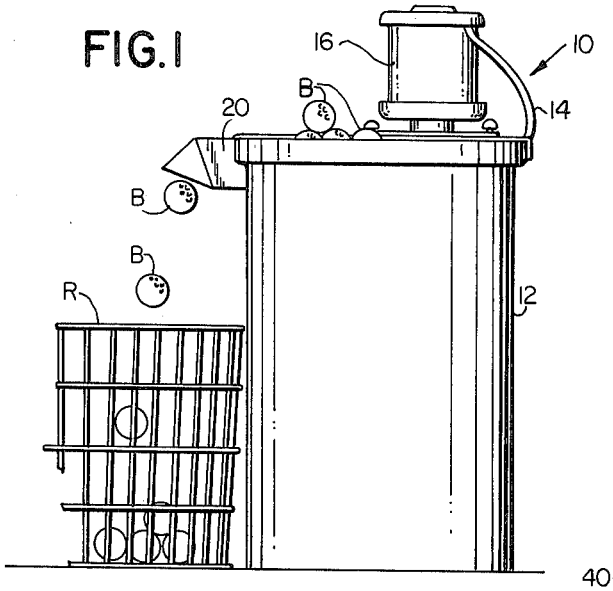
FIG. 1 is a side elevation view of the bll washing machine of the present invention and shows a plurality of washed balls being discharged from the machine into an adjacent basket.

FIG. 1 illustrates the washing machine generally designated 10, of the present invention during a washing process. The machine is utilized to wash spherical or ball-like objects such as golf balls, fruit, poultry eggs and the like, and the term "ball" as used in this specification and claims is intended to encompass such equivalent items.

The machine 10 is utilized to wash a plurality of balls of uniform shape in high volume and at high speed. The machine has particular utility as a golf ball washing machine and because of its ability to handle a high volume of loose balls, the machine may be used at driving ranges and other golfing facilities. It should be understood, however, that its utility is not limited to the golfing field and may be used in diverse other areas.

Figure 3:
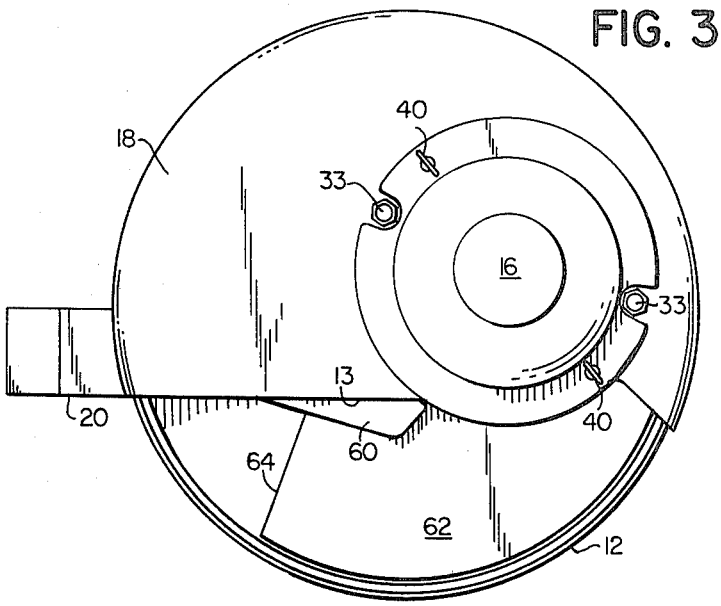
FIG. 3 is a top plan view of the washing machine in FIG. 2.

As shown in FIG. 1, the machine 10 is comprised of a large wash tub 12 in which a scrubbing unit is mounted during a washing operation. The scrubbing unit includes an electrical drive motor 16 with a power cord 14 mounted on a lid 18 which rests on the top of the tub. As seen more clearly in FIG. 3 the lid 18 fits generally over the open, circular top of the tub 12 but is cut away along a side 13 to define a fill opening through which the machine is filled with balls to be washed.

When usin the machine, loose golf balls B are poured in bulk into the tub through the opening exposed by the lid 18, and the tub is filled to capacity when the balls are exposed above the lid as illustrated in FIG. 1. A quantity of cleaning solution is also poured into the tub through the opening and the drive motor 16 is then turned on. During the washing process as explained in greater detail below, the balls are individually scrubbed and discharged through a spout 20 into a basket or receiver R. In a typical embodiment of the invention, the tub has a diameter of 15 inches (38 cm) and a height of 28 inches (71 cm) and is capable of cleaning up to 9,000 golf balls an hour.

Figure 2:
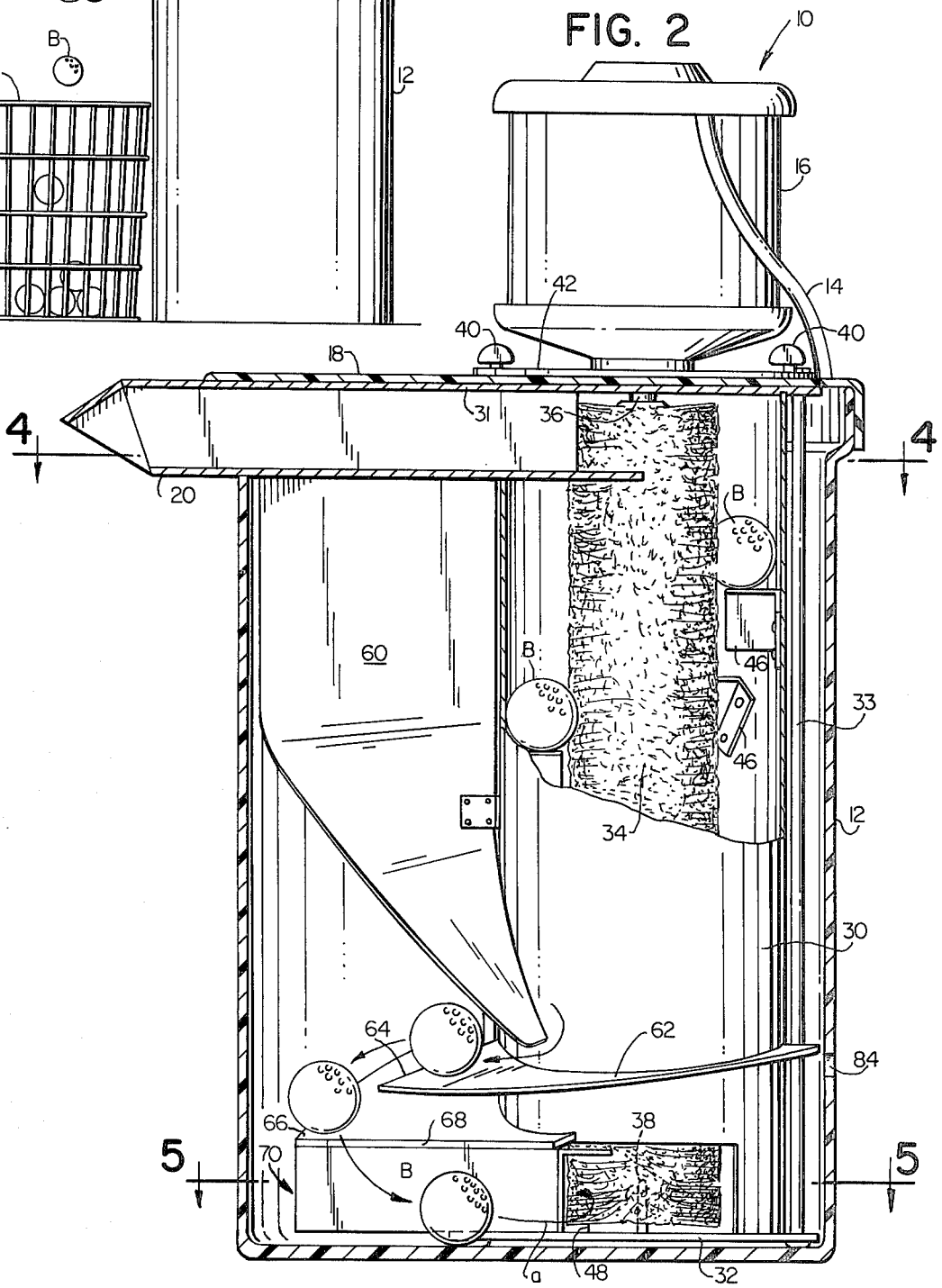
FIG. 2 is an enlarged elevation view of the washing machine in section with portions of the scrubbing chamber broken away.

FIG. 2 illustrates the basic components which form the scrubbing unit within the washing machine 10. A scrubbing chamber is formed by a generally cylindrical shell 30 positioned with its central axis oriented vertically within the tub. The upper end of the shell is clamped to the lid 18 for removal and insertion in the tub by means of a reinforcing plate 31 (which also forms the top side of the spout) a foot plate 32 at the bottom end of the shell and a pair of tension rods 33 extending between the lid and the foot plate at diametrically opposite sides of the shell. A scrub brush 34 having a generally cylindrical shape extends between the upper and lower ends of the chamber coaxially of the inner walls of the shell 30. The diameter of the brush and the diameter of the inner wall are selected so that the brush and the shell are in losely spaced relationship, and the annular space between the brush and shell is smaller than the diameter of the golf balls B so that the balls are sandwiched between the brush and the shell as shown for scrubbing.

The upper end of the brush 34 is secured to the drive shaft 36 of the motor 16 and is centered within the shell at that point by the shaft. The lower end of the brush is slidably mounted over a pin 38 in the foot plate 32 to center the brush in the lower portion of the shell. A pair of wing nuts 40 are connected to the mounting plate 42 of the motor 16 and attach the motor together with the brush 34 to the lid 18 and reinforcing plate 31 of the machine. Accordingly, the brush 34 and the motor 16 can be readily removed as a unit from the machine to inspect the scrub brush itself or to clear rocks or other debris which become lodged in the scrubbing chamber.

When the motor 16 is energized, the scrub brush 34 rotates within the shell 30. Golf balls that have been injected into the chamber between the brush and the shell revolve around the inner wall of the shell with the scrubbing action developed by the rotating brush.

Figure 6:
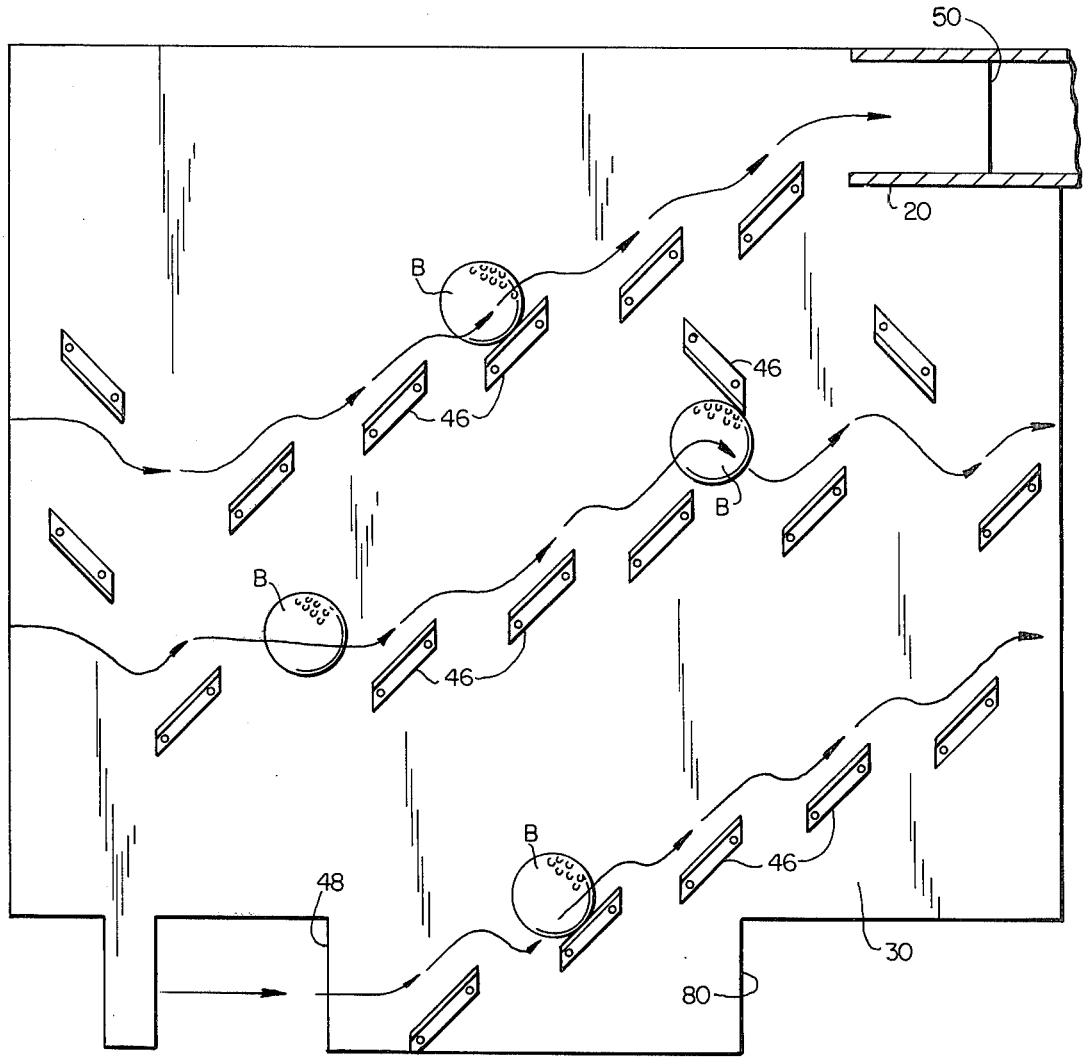
FIG. 6 illustrates the inside wall of the cylindrical scrubbing chamber when split open and flattened in a two dimensional configuration and shows the stepped brackets forming the track which carries balls upwardly through the chamber.

A track extends from the lower end of the shell 30 upwardly to the discharge spout 20 and is formed by a plurality of stepped brackets attached in a sequence to the inner shell wall and projecting into the annular space between the shell and brush. FIG. 6 shows the typical layout of the brackets as they would appear from inside the shell 30 if the shell were split and folded open in a flat condition. The brackets are inclined at various angles to the shell axis and, for the most part, are sloped upwardly relative to the ball motion to advance the balls from an inlet opening 48 at the lower end of the shell to discharge spout 20 and corresponding opening 50 at the upper end. Certain of the brackets in the stepped series are sloped downwardly and cause the golf balls B to momentarily reverse their generally upward movement within the shell. This reversal of motion subjects the balls to greater scrubbing action since it prolongs the exposure of the balls to the brush 34 inside the scrubbing chamber.

In accordance with one aspect of the present invention, loose golf balls B are deposited in bulk in the wash tub 12 through the opening at the top of the tub and fall into a stowage space defined between the tub walls and the shell 30. The balls rest en masse within the stowage space, and to prevent the balls from jamming or blocking the scrubbing mechanism, means are provided for feeding the balls in an orderly manner into the scrubbing chamber. The feeding means includes a number of guide baffles or panels mounted to the scrubbing unit in the stowage space between the tub and the shell for restricting or directing the movement of the deposited balls downwardly to an inlet opening 48 (FIGS. 2 and 6) at the lower end of the shell 30.

Figure 4:
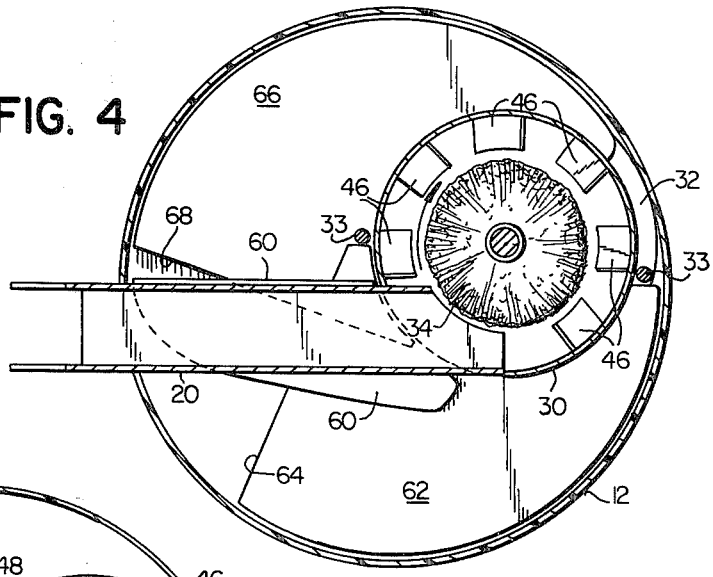
FIG. 4 is a transverse sectional view of the washing machine as viewed along the sectioning line 4—4 of FIG. 2.

A generally vertical baffle 60 extends downwardly from one side of the discharge spout 20 as shown in FIG. 4 and is connected along one vertical edge to the outer side of the shell 30. The upper end of the baffle 60 extends from the shell 30 radially outward along the discharge spout 20 to the outer part of the tub 12 while the lower end tapers to a narrow section and curves slightly around the shell under the fill opening. Thus, the baffle 60 confines golf balls in the upper part of the tub to the semi-cylindrical region of the stowage space directly below the tub opening while other golf balls at the lower part of the tub are permitted to fall down and around the panel 60 as shown in FIG. 2.

Another baffle or panel 62 attached to the shell 30 extends in a generally horizontal direction around the lower end of the shell to a lower lip 64 generally below baffle 60. As seen most clearly in FIGS. 3 and 4, the outer periphery of the baffle 62 conforms generally to the inner surface of the tub 12 so that golf balls deposited in the tub through the opening of the lid 18 generally drop onto the baffle 62 between the tub wall and the baffle 60. Such balls may then roll or slide progressively downward to the lip 64 and further downward to the bottom of the tub.

An additional baffle 68 is attached to and extends around the lower end of the shell 30 from a side of the shell generally diametrically opposite that to which the baffle 62 connects. The baffle 66 slopes downwardly to a lower lip 68 in the same region of the tub as the baffle 64, but the lower lip 68 of the baffle is disposed closer to the bottom of the tub 12 than the lip 64 and extends partially under the baffle 62 in a plane generally perpendicular to the lip 64. The baffle 66 overlies a feed conduit 70 attached to the lower end of the shell 30 for feeding golf balls one by one into the scrubbing chamber as described below. The baffle 66 like the baffle 62 has an outer periphery conforming generally to the inner surface of the tub 12 as shown in FIG. 4, and prevents golf balls in the stowage space from stagnating in the area immediately above the fluid conduit 70.

Accordingly, the baffles 60, 62 and 66 guide the golf balls from the stowage space into the lower portion of the tub 12 adjacent the fluid conduit 70. It will be noted most clearly in FIG. 1 that the golf balls from the stowage space follow a generally serpentine path around the baffles 60, 62 and 66 and develop a more linear series or grouping of balls as the bottom of the tub 12 is approached. This grouping of the balls as they progress through the machine 10 prevents the mass of balls at the upper parts of the stowage space from creating blockages or jamming the machine.

Figure 5:
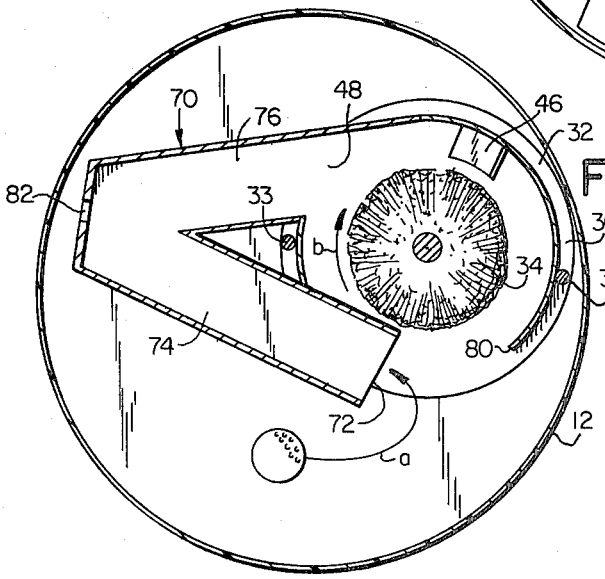
FIG. 5 is also a transverse sectional view of the washing machine as viewed along the sectioning line 5—5 of FIG. 2.

The feed conduit 70 is a throttled fluid feed conduit which draws golf balls in the bottom of the tub into the conduit entrance 72 at one end as indicated by the arrow a in FIGS. 1 and 5, transmits the balls in serial order through a fluid throttling passageway and injects the balls one by one tangentially into the scrubbing chamber between the brush 34 and the shell 30. The conduit 70 is comprised of a first branch 74 defining the entrance at one end and a second branch 76 connecting with the first and leading to the inlet opening 48 of the shell. The entrance 72 is situated adjacent a shell discharge opening 80 located remotely from the inlet 48 insofar as the rotation of the brush is concerned. For the fluid feed conduit to operate, the tub 12 is filled with a cleaning solution up to the level of an overflow port 84 shown in the wall of the tub in FIG. 2. Such solution submerges the fluid conduit 70 and also fills the interior of the shell 30 at the lower end. When the scrub brush 34 is rotated in the direction indicated by the arrow b in FIG. 5, the cleaning solution is pumped through the lower end of the shell 30 and circulates through the bottom of the tub by way of the inlet opening 48 and the discharge opening 80. Some of the fluid discharged at the opening 80 passes into the branch 74 of conduit 70 due to the tangential arrangement of the branches 74, 76 and the shell. Fluid entering the branch 74 draws with it golf balls in the immediate vicinity of the entrance 72. By sizing the cross section of the branch 74 appropriately, the golf balls pass one by one through conduit and into the scrubbing chamber.

The side wall of the conduit 70 at the junction of the branches 74 and 76 includes a throttling port or orifice 82 through which additional cleaning solution is drawn due to suction at the shell inlet opening 48. The additional solution accelerates the balls through branch 76 and into the shell 30 so that the balls separate and enter the scrubbing chamber in spaced relationship. By appropriately sizing the throttling port 82 the degree of acceleration and the speed at which the balls are fed into the shell is more accurately controlled.

Once the balls are within the shell, the scrubbing action of the rotating brush 34 moves the balls progressively upward through the shell along the track defined by the angled brackets 46. The scrubbing action of the brush in conjunction with the cleaning solution removes dirt and grime from the exterior of the balls during the course of their upward travel in opposition to gravitational forces. When the balls reach the end of the track at the upper end of the shell, they are discharged through the tangentially oriented spout 20 into an adjacent basket R or other ball receiver.

While the present invention has been described in a preferred embodiment, it should be understood that numerous modifications and substitutions can be had without departing from the spirit of the invention. For example, the number of angled brackets which form the track in the shell 30 may be varied, and the particular arrangement of the brackets for directing balls either upwardly or downwardly may be varied in accordance with the desired length of the scrubbing path through the shell. It is also clear that a continuous, helical track may be utilized within the shell 30 to advance golf balls upwardly as they are scrubbed by the rotating brush 34. The specific configuration of the baffles shown in the drawings and the number of baffles may be changed in accordance with the geometry of the tub and shell as well as the location of the inlet of the conduit 70. The throttled fluid conduit may have a number of configurations for drawing golf balls from the bottom of the tub into the scrubbing chamber. The particular conduit illustrated and its positional relationship relative to the openings 48, 80 and brush rotation is advantageous for encouraging a continuous circulation of cleaning solution through the bottom of the tub and injection of golf balls into the shell. All of the scrubbing components are attached to the lid 18 of the machine for ready removal as a single unit, but it will be readily apparent that a number of the components may be attached permanently to the inside of the tub without interfering with the basic washing function performed by the machine. A number of components in the machine may be made or constructed of either a heavy gage plastic or light weight metal. In one embodiment stationary members such as the lid, the tub and baffles are constructed of plastic while the shell and the fluid injection conduits which have rubbing contact with the balls are constructed of aluminum with or without a plastic liner. Accordingly, the present invention has been described in a preferred embodiment by way of illustration rather than limitation.

I claim:

1. A machine for washing a plurality of uniform balls or the like comprising:

a tub having an opening at the top and a closed bottom for holding a quantity of cleaning solution;

a scrubbing chamber including a generally cylindrical shell extending vertically in the tub and defining a stowage space between the tub and shell for holding a plurality of balls to be scrubbed and a rotatable scrub brush mounted coaxially within the shell in spaced relationship from the cylindrical shell wall, the lower end of the shell having an inlet opening for admitting balls to be scrubbed and the cleaning solution, the shell also including track means leading from the lower end to the upper end in the space between the shell and the brush for carrying the balls sandwiched between the brush and shell upwardly as the brush rotates and scrubs the balls;

motor means for rotating the scrub brush coaxially within the shell; and feeding means leading from the stowage space between the tub and the shell to the inlet opening for feeding balls deposited loosely in the stowage space in an orderly manner to to the inlet opening of the shell, the feeding means including conduit means connected to the inlet opening of the shell and defining a fluid throttling passageway through which the balls pass in serial order, the conduit means having a throttling orifice admitting fluid into the passageway with the balls at a controlled rate.

2. A machine for washing balls and the like as defined in claim 1 wherein the feeding means includes guide baffles mounted in the stowage space between the tub and the shell of the scrubbing chamber for restricting the movement of a plurality of balls toward the inlet opening at the lower end of the shell.

3. A machine for washing as defined in claim 2 wherein the guide baffles positioned in the stowage space define a serpentine passage leading to the inlet opening of the shell.

4. A machine for washing balls and the like as defined in claim 1 wherein the fluid passageway of the feeding means has a ball entrance at one end and an exit connected to the inlet opening of the shell at the opposite end, and the throttling orifice is located in the conduit means intermediate the entrance and exit.

5. A machine for washing as defined in claim 4 wherein the shell at the lower end has a second opening different from the inlet for discharging cleaning fluid from the shell whereby the cleaning solution circulates in the bottom of the tub through the shell by means of the entrance and the throttling orifice of the conduit means and the second opening.

6. A machine for washing balls and the like as defined in claim 1 wherein the conduit means connects with the inlet opening of the shell in a position locating the fluid passageway generally tangentially of the shell.

7. A machine for washing balls and the like as defined in claim 6 wherein:

the lower end of the shell has a discharge opening remote from the inlet opening for discharging solution admitted to the shell with the balls; and the inlet of the conduit means is located adjacent the discharge opening of the shell.

8. A machine for washing balls and the like as defined in claim 1 wherein the conduit means is located in the lower part of the tub; and the feeding means further includes guide baffles in the stowage space between the shell and the tub and above the conduit means for guiding balls downwardly to the conduit means in the lower part of the tub.

9. A machine for washing balls and the like as defined in claim 1 wherein the track means within the shell of the scrubbing chamber comprises a series of stepped members attached to the inside wall of the shell and extending from the wall into the space between the scrub brush and shell.

10. A machine for washing balls as defined in claim 1 further including a discharge spout connected with the shell at the upper end of the track means.

11. A machine for washing balls and the like as defined in claim 1 wherein the scrubbing chamber, the motor means and the feeding means are interconnected as a unit for removal from the tub.

12. A machine for washing a plurality of uniform balls or the like comprising:

a tub having a closed bottom for holding a quantity of cleaning solution and a stowage space for holding a plurality of balls to be scrubbed;

a scrubbing chamber including a generally cylindrical shell extending vertically in the tub and a rotatable scrub brush mounted coaxially within the shell in spaced relationship from the cylindrical shell wall, the lower end of the shell having an inlet opening for admitting balls to be scrubbed and the cleaning solution held in the tub, the shell also including track means leading from the lower end to the upper end in the space between the shell and the brush for carrying the balls sandwiched between the brush and shell generally upwardly as the brush rotates and scrubs the balls, the track means being comprised by a plurality of stepped members arranged in a sequence within the shell between the brush and the shell, the stepped members being sloped at different angles relative to the vertical to vary the scrubbing action on the balls;

motor means for rotating the scrub brush coaxially within the shell; and feeding means leading from the stowage space in the tub to the inlet opening of the shell for feeding balls deposited in the stowage space in an orderly manner into the scrubbing chamber.

13. A machine as defined in claim 12 wherein a selected few of the stepped members are sloped downwardly with respect to ball movement within the shell to increase the scrubbing action.

14. A golf ball washing machine comprising: a wash tub having an opening at the top for receiving a plurality of golf balls to be washed; a scrubbing unit mounted within the tub and defining between the unit and the walls of the tub a stowage space for the golf balls received through the opening at the top of the tub, the scrubbing unit including a scrub brush rotatable about a vertical axis in the tub and a shell surrounding the brush in closely spaced relationship whereby golf balls positioned between the shell and brush are scrubbed as the brush is rotated, a track extending around and from the lower to the upper part of the shell and cooperating with the brush to move golf balls progressively upward as the brush is rotated within the shell, the scrubbing unit also including feeding means for directing golf balls into the shell at the lower end, the feeding means including a set of baffle panels positioned within the stowage space between the shell and tub and dividing the plurality of balls in the stowage space into a more linear series of balls adjacent the lower end of the shell, and fluid injection means at the lower end of the stowage space connecting into the lower end of the shell to transmit fluid pumped by the rotated scrub brush for drawing the golf balls from the more linear series and injecting the balls one by one between the brush and shell at the lower end.

15. A golf ball washing machine as defined in claim 14 wherein:

the lower end of the shell has a fluid inlet opening and a fluid discharge opening between which fluid is circulated by the rotated scrub brush; and the fluid injection means includes a conduit connecting with the inlet opening of the shell whereby the fluid circulated by the brush flows through the conduit with golf balls from the stowage space.

16. A golf ball washing machine as defined in claim 15 wherein the entrance of the fluid conduit is located hear the fluid discharge opening of the shell.

17. A golf ball washing machine as defined in claim 14 wherein the tub contains a fluid overflow port at a fluid level in the tub above the fluid injection means.

18. A golf ball washing machine as defined in claim 14 wherein the conduit connects with the inlet opening of the shell tangentially of the rotated brush.

19. A golf ball washing machine as defined in claim 1 or 14 wherein the rotatable scrub brush is slidably mounted over a pin at the lower end of the shell to center the brush within the shell and facilitate removal from the shell.

20. A machine for washing a plurality of uniform balls or the like comprising:

a tub having an opening at the top and a closed bottom for holding a quantity of cleaning solution;

a scrubbing chamber including a generally cylindrical shell extending vertically in the tub and a rotatable scrub brush mounted coaxially within the shell in spaced relationship from the cylindrical shell wall, the lower end of the shell having an inlet opening for admitting balls to be scrubbed and the cleaning solution, the shell also including track means leading from the lower end to the upper end in the space between the shell and the brush for carrying the balls sandwiched between the brush and shell upwardly as the brush rotates and scrubs the balls;

motor means for rotating the scrub brush coaxially within the shell;

the tub and the shell of the scrubbing chamber cooperatively defining a stowage space occupying the region between the outer side of the shell and the inner side of the tub, the stowage space extending to the opening at the top of the tub to receive the balls in bulk; and feeding means leading from the stowage space between the tub and the shell to the inlet opening for feeding balls in the stowage space in an orderly manner to the inlet opening of the shell, the feeding means including a plurality of guide baffles extending through the stowage space from the outer side of the shell to the inner side of the tub and forming a serpentine passage leading downwardly in the stowage space toward the inlet opening of the shell.

* * * * *